United States Patent [19]

Bourdon

[11] 4,370,014

[45] Jan. 25, 1983

[54] INSULATED WIRE TERMINATION DEVICE

[75] Inventor: Normand C. Bourdon, Unadilla, N.Y.

[73] Assignee: The Bendix Corporation, Southfield, Mich.

[21] Appl. No.: 205,204

[22] Filed: Nov. 7, 1980

[51] Int. Cl.[3] ..... H01R 11/20

[52] U.S. Cl. ..... 339/97 R

[58] Field of Search ..... 339/97 R, 97 C, 97 P, 339/97 T, 98, 99 R

[56] References Cited

U.S. PATENT DOCUMENTS

| | | | |
|---|---|---|---|
| 2,419,683 | 4/1947 | Henschke | 339/97 R |
| 2,534,881 | 12/1950 | Schroeder | 339/97 R |
| 2,702,895 | 2/1955 | Pavlinetz | 339/97 C |
| 3,553,631 | 1/1971 | Shlesinger, Jr. | 339/97 P |
| 4,261,632 | 4/1981 | Narozny | 339/97 C |

FOREIGN PATENT DOCUMENTS

| | | | |
|---|---|---|---|
| 1109914 | 4/1968 | United Kingdom | 339/97 R |

*Primary Examiner*—Joseph H. McGlynn

*Attorney, Agent, or Firm*—Charles D. Lacina; Raymond J. Eifler

[57] ABSTRACT

An electrical contact includes means for piercing the insulation of an insulated conductor wire, the piercing means including inner and outer coaxially interfitted sleeves slidably disposed for movement between first and second axial positions which define an electrically unconnected and an electrically terminated position with respect to the wire. One embodiment includes the outer sleeve having diametrically disposed openings, the inner sleeve having a pair of axial slots disposed in register with the openings, a deflectable arm extending radially outwardly from an axial end of each slot and through a respective opening with each arm including a pointed end for piercing the insulation of the wire. Means for locking the sleeves in the terminated position include a resilient lance being adapted to spring outwardly from the inner sleeve to abut an end of the outer sleeve. In operation, a wire is inserted into the wire receiving end of the inner sleeve in the first position. The two sleeves are axially displaced to the second position whereby an edge of the opening cams against the arms and forces them to deflect downwardly and the pointed ends into the insulation of the wire to achieve an electrical connection with the conductive portion of the wire.

18 Claims, 14 Drawing Figures

INSULATED WIRE TERMINATION DEVICE

The present invention relates to an electrical contact for piercing the insulation of a discrete electrical wire to make a strain relieved electrical connection therewith and in particular to an insulation piercing contact including a pair of coaxial sleeves slidably disposed to deflect a wire piercing end on a cantilevered arm into electrical connection with the wire.

BACKGROUND OF THE INVENTION

For many years manufacturers have supplied users of electrical connector components with electrical contacts for terminating an insulated conductor wire. One termination method commonly used has been to mechanically strip the insulation from the wire to expose a conductive end portion of the wire and then to crimp a portion of the contact sleeve to the wire end by controlled compression and displacement of the contact metal. Some of the steps necessary to obtain a desired crimp depend on or are a function of wire end preparation, crimp depth and control of the crimp depth. The crimp depth must be predetermined for each contact-to-wire application and is obtained by a crimping tool indentor. Controlling the crimp depth is established by ratchet means on the crimping tool which allow the crimping tool's handles to reach full closure (representing the bottoming position of the crimping operation) and the indentor to be released. Irrespective of contact sleeve size, the crimping mechanism release point and indentor bottoming position must be selected by the operator.

One major disadvantage with the above approach is that the wire must be prepared first. A wire stripping operation is not only time consuming but care must be taken in selecting the tool which strips the insulation so as to avoid damage to the conductors. A further disadvantage with the above method is that the tool operator could mistakenly select improper crimping settings, thereby resulting in poor and/or unacceptable terminated wire-to-contact interconnections.

Another method of electrically terminating an insulated wire is by an insulation displacement technique. The insulation displacement method of terminating a wire to an electrical contact requires no previous removal of the insulation from a wire before assembly. In this form of electrical termination the wire typically lays across a pair of spaced slots. An assembly tool typically wedges each wire home into a slot of the contact receiving the wire and a contact portion pierces and/or displaces the insulation surrounding the conductive wire portion. Typical examples of insulation piercing contacts are illustrated by U.S. Pat. Nos. 3,012,219; 3,147,058; 3,617,983; 3,879,099 and 3,964,816.

A major disadvantage with the above technique, is the need for a plastic (molding) housing to retain the insulated conductors in the terminated position. Without this protection, the terminated connection will not be locked in place and the interconnection would not be strain relieved. A further disadvantage with this method is that the assembly tool must bear down onto the housing to force the wire inwardly of a wire receiving slot of the contact. The reliability of the termination in the slot is not certain. In some multi-termination apparatus shown by the prior art, to replace one contact-to-conductor termination, all of the terminations need to be dislodged and then reestablished.

A more desirable contact would be one which provides the user with a contact that is self-contained, which provides means for assuring that the wire is properly positioned for termination, which may be used without requiring a separate housing molding, which provides a sturdy insulation piercing member, which encloses the wire and strain relieves the termination and which locks the contact and the wire termination achieved.

DISCLOSURE OF THE INVENTION

Accordingly, the invention is characterized by an electrical contact 100 comprising a central body member 120 having a shoulder 121, a mateable portion 110 extending forwardly from the body and an insulation piercing portion extending rearwardly from the central body, the insulation piercing portion including a pair of coaxial sleeves 510, 520 telescopically interfitted one over the other and adapted to be slidably displaced by jaws 24. 25 of a tool 20 from a first to a second axial position defining respectively electrically unconnected and electrically terminated conditions. The insulation piercing portion comprises the first (outer) sleeve 510 having a pair of openings 514 adapted to receive therethrough one of a like pair of cantilever arms 600 extending outwardly at an acute angle from the second (inner) sleeve 520, each cantilever arm 600 having one end 601 secured at its root adjacent an inner sleeve axial slot 524 exposing the wire end and having a sharp pointed end 700 extending therefrom for piercing the insulation 301, each of the arms 600 being deflected downward by an edge 515 of each opening 514 being cammed against the arm as the sleeves are moved from the first to the second positions. As the cantilever arms are deflected downwardly, the sharp pointed ends 700 cut into and through the insulation 301 to make electrical contact with the conductive portion of the wire 300. Each of the openings 514 and cantilever arms 600 cooperate to provide means for detaining the two sleeves in the first (unconnected) position and the openings cooperate with the slots 524 to provide the user with means for visually inspecting whether or not the wire 300 has been fully seated within the inner sleeve 520 and against a wire stop 121 prior to sliding the sleeves to the second (connected) position.

Several important advantages are achieved by a contact of the type described above. First, several positions of contact due to piercing of conductors are provided. The contact is capable of providing a self-locking termination. Prior preparation of wires is eliminated. The contact itself may, if desired, be used without a surrounding molding or connector body assembly.

DETAILED DESCRIPTION OF THE INVENTION

Figures 1, 2, 6A, 6B, 6C:
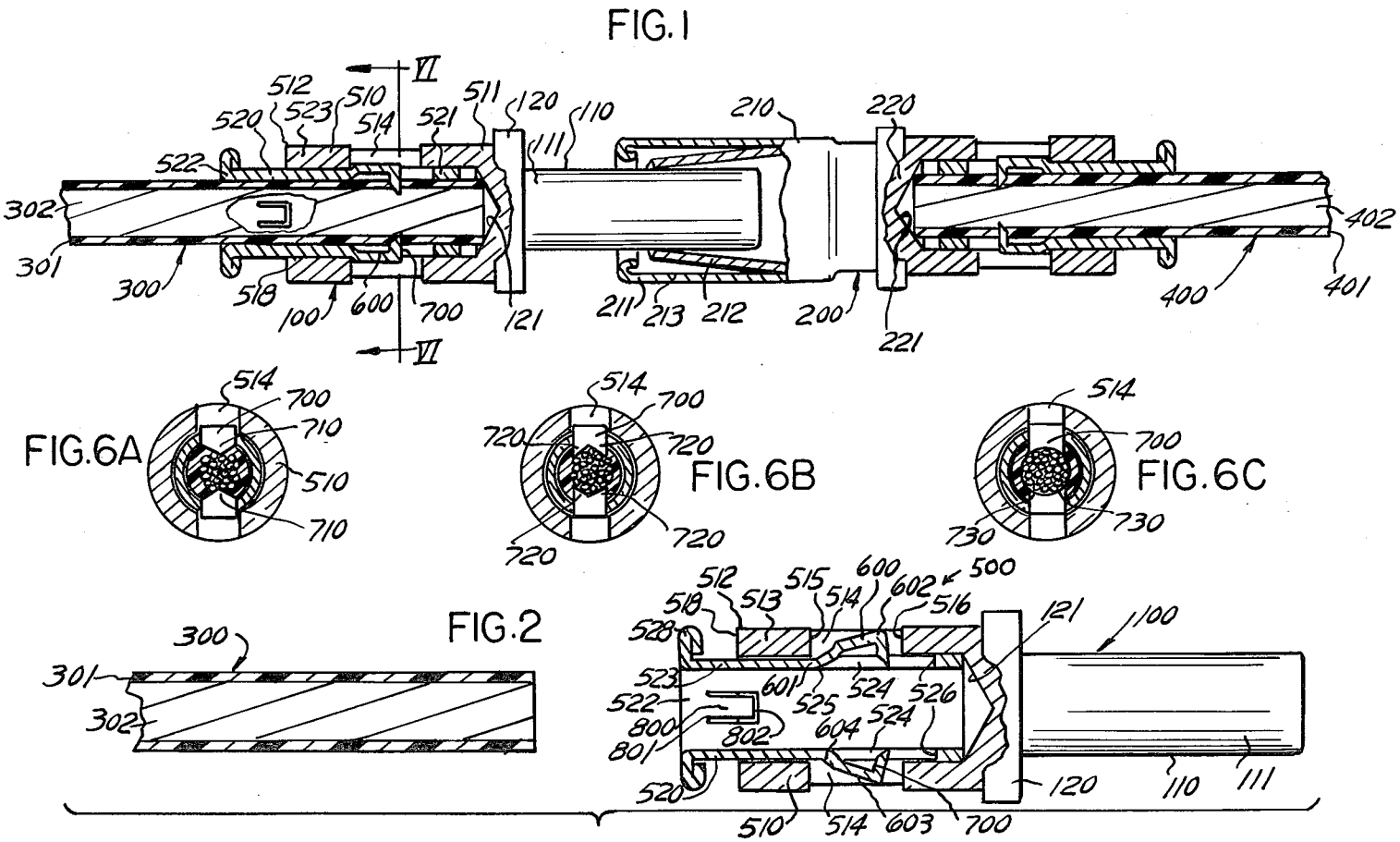
FIG. 1 is a cross-sectional view of a pair of contacts having forward ends mating and rearward ends with like insulation piercing portions terminating an insulated wire according to the principles of the present invention.
FIG. 2 is a cross-sectional view of one of the contacts of FIG. 1 showing the insulation piercing portion thereof about to receive an insulated wire.
FIGS. 6A, 6B and 6C are taken along lines VI—VI of FIG. 1 and illustrate a pointed end of the contact piercing the insulation of the wire.

Referring now to the drawings, FIG. 1 illustrates partially in section an electrical interconnection between a pin contact 100, a socket contact 200 and a pair of insulated wires 300, 400. Each axially extending contact 100, 200 is similar and comprises, respectively, a central body member 120, 220 having a shoulder 121, 221 and a pair of oppositely disposed radial abutment faces, a mating portion 110, 210 extending axially forwardly from the central body, means including a pair of sleeves extending axially rearwardly from the central body for terminating one wire end and releasable means for locking the wires in the terminated position. Each insulated wire 300, 400 is similar and comprises, respectively, an outer cover 301, 401 of insulative material which circumposes an inner core 302, 402 of conductive material. The inner core could be stranded or solid.

The contact mating portions 110, 210 are shown as comprising a tubular pin 111 designed for telescopic engagement with a socket 211, the socket being formed by a pair of spring members 212 and a hood 213. The mating portions could be other than that shown and could include hermaphroditic "brush-type" mating ends such as shown by the U.S. Pat. No. 3,725,844 filed Mar. 15, 1971 and entitled "Hermaphroditic Electrical Contact".

Preferably and in accord with the present invention, each contact 100, 200 is adapted to be used in a separable electrical connector assembly (not shown) comprised of a pair of electrical connector members, one of said connector members being a receptacle and the other being a plug adapted to mate with the receptacle, each of the connector members including a dielectric insert with at least one socket contact 200 being mounted in the insert of one member and the pin contact 100 corresponding to the socket contact being mounted in the insert of the other member and adapted for mating engagement with the socket contact when the plug and receptacle are in mated relationship. A suitable assembly is shown in U.S. Pat. No. 4,082,398 filed Oct. 21, 1976 and entitled "Electrical Connector With Front and Rear Insertable and Removable Contacts." Free ends of retention fingers disclosed therein face each other to define a cavity captivating an enlarged portion of a contact such as shoulders 120, 220 of the contacts herein.

Means for terminating 500 like ends of the insulated wires 300, 400 to provide the electrical connection therebetween are identical to each contact and accordingly only one contact (viz. the pin contact 100) will be described in the following discussion. The wire terminating means 500 include a first outer sleeve 510 defining an interior bore and having one end 511 secured to the body 120 and the other end 512 extending axially rearward therefrom, a second inner sleeve 520 defining an interior bore and coaxial with and telescopically interfitted within the first sleeve and provided with a forward end portion 521, a rearward wire receiving end portion 522 and a pair of medial diametrically opposed cantilever arms 600 including pointed ends 700, the inner sleeve 520 being circumposed about the wire end and the pointed ends 700 being pierced through the wire insulation 301 to make electrical contact with the conductive inner core 302 of the wire.

FIG. 2 illustrates the terminable end portion of the wire 300 about to be inserted into the wire receiving end portion 522 of the pin contact 100. The description to follow is equally applicable to the socket contact 200.

The outer sleeve 510 is axially extending and includes a generally peripherally closed tube defined by a wall 513 having a pair of diametrically spaced openings 514 axially spaced from the mating end of the contact, the rearward end 512 thereof having a radial face 518. Each opening 514 has a pair of axially spaced ends 515, 516 with the rearward end 515 defining a cam-like edge.

The inner sleeve 520 is axially extending and includes a generally peripherally closed tube defined by a wall 523 and a pair of diametrically disposed slots 524 having spaced axial ends 525, 526, the slots 524 being in register with the openings 514. The inner sleeve 520 is coaxial with and sized to slidably fit within the outer sleeve 510 and adapted to be axially displaced between a first and electrically unconnected contact position to a second and electrically terminated contact position. As shown in FIG. 2, the sleeves are disposed in the first and electrically unconnected position. Forward and rearward end portions respectively of the inner sleeve 520 interfit within and extend outwardly of the outer sleeve 510. The rearward wire receiving end portion 522 of the inner sleeve 520 includes a transverse reinforced radial lip 528. The rearward end portion of the inner sleeve is adapted to clearance fit about the terminable end portion of the wire and to strain relieve the resulting termination.

The releasable means for locking the sleeves in the second (and electrically terminated) position includes a resilient lance 800 struck from the rear end portion wall 523 of the inner sleeve 520, the lance having a root 801 and a free end 802 adapted to spring radially outwardly from the inner sleeve when the inner sleeve is displaced to the second position, the free end 802 butting against the radial face 518 of the outer sleeve. Preferably and in accord with this invention, the lance 800 is disposed about 90° from both the slots 524 and the openings 514.

The cantilever arms 600 are struck from the wall 523 and are resiliently deflectable inwardly and outwardly of the inner sleeve outer surface relative to their roots 601 secured to like axial rearward ends 525 of the respective slots 524, each arm 600 extending divergently outward from the sleeve at an acute angle to a deflectable free end 602. An abutment shoulder 604 is disposed forwardly of the root 601 on the exterior surface 603. The cantilever arms 600 are adapted to extend through the respective openings 514 whereby the two sleeves are detained together (and ready for receiving a wire end) in the first position.

The cantilever arms 600 include the sharp insulation piercing points 700 at their free ends 602, each of the points converging towards one another and towards the sleeves. In some applications, one deflectable cantilever arm may be adequate. However, at least two cantilever arms are preferable to distribute stresses uniformly about the sleeves when the sleeves are displaced during wire termination and to increase electrical contact redundancy.

Figure 3:
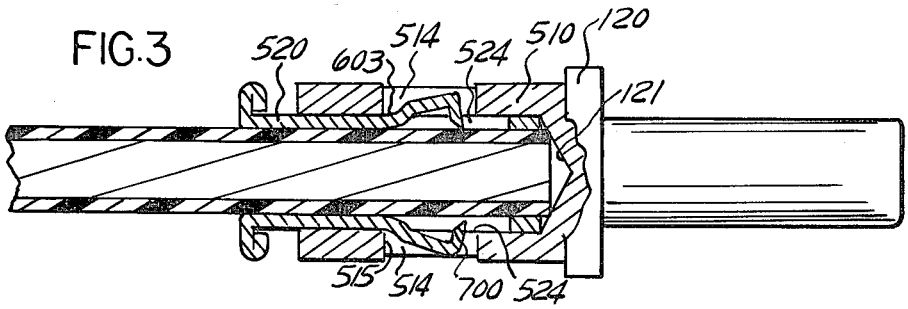
FIG. 3 is a cross-sectional view of the insulation piercing portion of the contact shown in FIG. 2 receiving the wire.

FIG. 3 illustrates the pin contact 100 having received the insulated wire 300 with the inner sleeve 520 being disposed in the first position and with the wire end disposed in its most forward position prior to termination. The interior junction of the outer sleeve 510 with the body 120 defines a wire stop 121 which tells the user that the wire has been properly received for terminating. Further, the register position of slot 524 with opening 514 allows a visual inspection of the wire fitment prior to termination.

Figure 4:
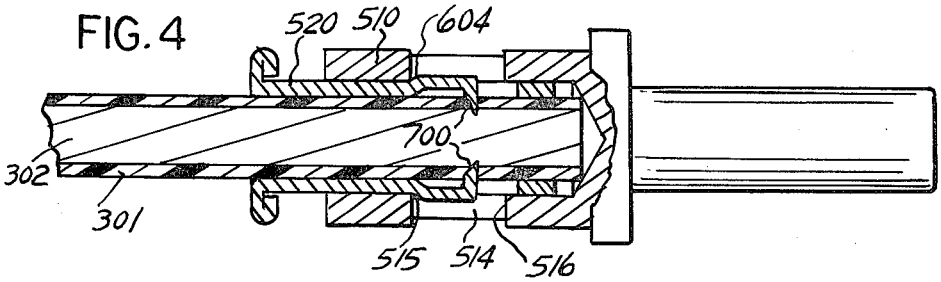
FIG. 4 is a cross-sectional view of the insulation piercing portion of the contact shown in FIG. 2 terminated with the wire.

FIG. 4 shows the inner sleeve 520 displaced into the second (axially rearward) position relative to the outer sleeve 510 representing the final terminated connection. The pointed tips 700 are shown pierced through the wire insulation 301 and contacting the conductive portion 302. The cam-like edge 515 of opening 514 is abutted against the shoulder 604 of the cantilever 600 firmly seating the arm in the deflected position.

Figure 5:
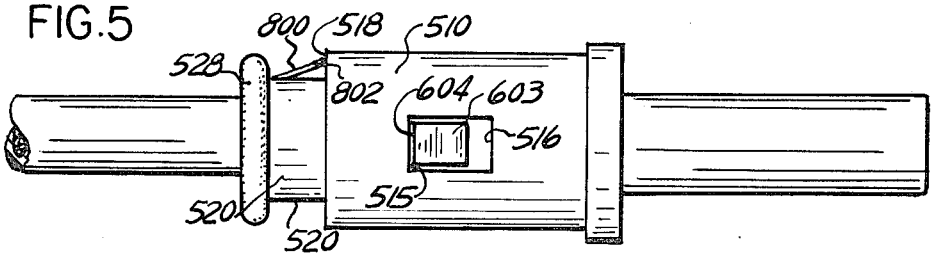
FIG. 5 is a view of the termination shown in FIG. 4 with the contact rotated to show a member locking the wire and contact in the terminated position.

FIG. 5 illustrates the final terminated connection of FIG. 4 rotated 90° showing the lance 800 locking the sleeves apart in the termination position, the lance free end 802 abutted against the rearward radial face 518 of the outer sleeve 510.

FIG. 6A shows one embodiment of the pin contact 100 insulation piercing end 700. The pointed end 700 is concave, elongated V-shaped and includes one sharp spear tip 710. In the situation where the conductive wire portion is stranded the tip of the spear makes contact with a greater number of stranded wires.

FIG. 6B illustrates an alternate embodiment of the insulation piercing end 700. The pointed end 700 is convex, V-shaped and defines two pointed biting tips 720. As before, the elongated V-shape makes contact with a greater number of stranded wires.

FIG. 6C illustrates another alternate embodiment of the insulation piercing end 700. The contact end is circular shaped having distal points 730 and is preferably for penetrating a solid insulated conductor.

Figure 7:
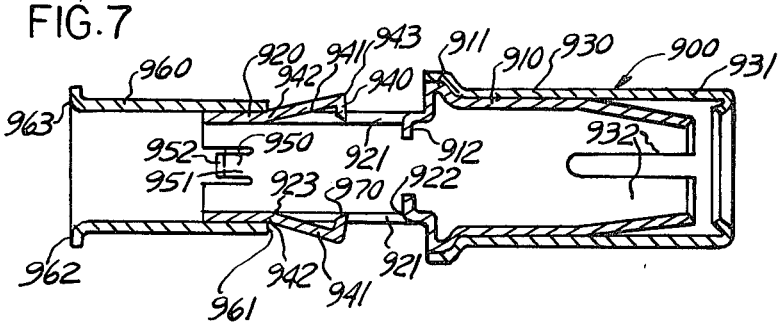
FIGS. 7 and 8 illustrate an alternate embodiment of the invention.

FIG. 7 illustrates an alternate embodiment of the invention. In this embodiment, there is a socket-type contact 900 including a body 910 having a central shoulder 911, a tubular wire receiving inner sleeve 920 extending rearwardly from the shoulder, a wire stop 912 interiorly disposed in the inner sleeve, a mating portion 930 extending forwardly from the shoulder, wire insulation piercing means 940 and terminated wire locking means 950. A separate terminating outer sleeve 960 is slidably assembled over the inner sleeve 920.

The mating portion 930 includes a tubular hood 931 pressed over a pair of spring members 932 to define the socket. The mating portion could equally be provided with the pin-type contact or with "brush-type" contacts.

The inner sleeve 920 includes a pair of diametrically opposed slots 921 having axial ends 922, 923. The (outer) terminating sleeve 960 is axially extending and includes free axial ends 961, 962 with the forward axial end 961 thereof defining a cam-like edge and the rearward axial end 962 having a radially flared portion 963 adapted to provide an engagement surface for an installation tool.

The insulation piercing means 940 comprises a pair of cantilever arms 941 having their root ends 942 secured to the rearward axial end 923 of the inner sleeve 920 slot 921 and a deflectable free end 943 provided with a sharp wire penetrating portion 970. Each of the arms extend (diverge) outwardly from the inner sleeve 920 and from one another and the penetrating portions 970 converge inwardly towards one another.

The locking means 950 comprise the inner sleeve 920 having struck therefrom an outwardly extending lance or finger 951 having an end 952 adapted to flex inwardly and outwardly to engage the flared end 962 of the outer sleeve 960.

Electrical termination is achieved by moving the outer sleeve 960 from the first (electrically unconnected) position axially towards the body 910 and to a second (electrically terminated) position.

Figure 8:
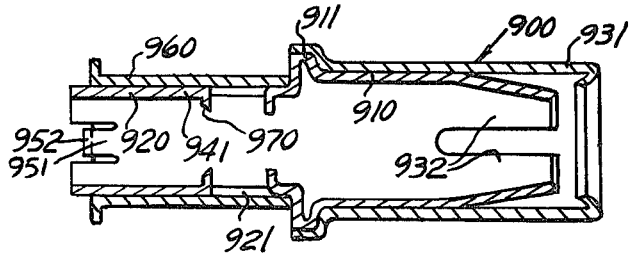
Figure 9:
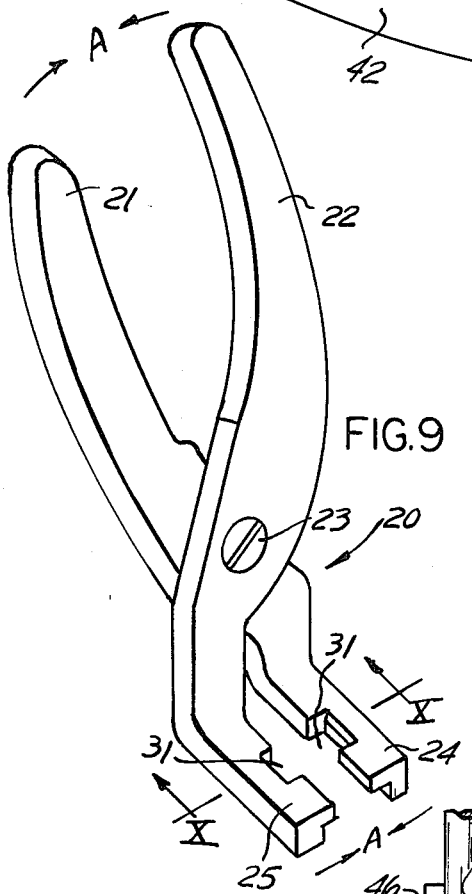
FIG. 9 illustrates a tool for use with the wire piercing contact shown in FIGS. 1-6.

FIG. 8 illustrates the socket contact assembly of FIG. 9 with the inner sleeve 960 locked in the second (electrically terminated) position by the end 952 of finger 951. The insulated wire is omitted for clarity.

OPERATION

Preferably and in accord with the invention, in operation, a plier-like tool would be utilized to grip the contact and advance the contact sleeves between the first and second axial positions.

Turning now to FIG. 9, a first plier-type tool 20 for use with the electrical contacts 100, 200 comprises a pair of body members 21, 22 pivotally coupled by a pin 23 with each body including a handle and a jaw, the body members being adapted to move in a direction "A" to complete the termination between the contact and the conductor 300. Each jaw 24, 25 includes a recess portion 31 having an edge 30 disposed medially a pair of chamfered surfaces 26, 28.

Figure 10:
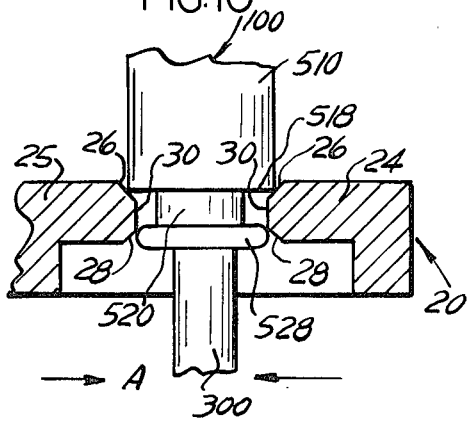
FIG. 10 is a sectional view of the tool of FIG. 9 taken along lines X—X showing the contact of FIGS. 1-6 being received therein.

Turning to FIG. 10, the contact 100 is positioned in the recess such that the tool surfaces 26 position against the contact edge 518 and the tool surfaces 28 position against the contact lip 528. The operator would cause the body parts to move in the direction "A" causing the edges 26, 28 to cam against the contact surfaces 518, 528, whereby the sleeves axially displace away from one another. Continued motion of the jaws 24, 25 causes the sleeve 510 to cam against the cantilever arms 600 and deflect them and their pointed ends 700 downwardly, driving the pointed ends into the wire received therein. By continued squeezing together of the jaws the user knows the final terminated position is achieved when the lance 800 on the inner sleeve 520 snaps outwardly against the radial face 518 of the outer sleeve 510 and the cam edge 515 abuts the cantilever arm shoulder 604. The shoulder 604 serves to limit axial movement of the inner sleeve and the lance assures the user that the termination is "locked".

Figure 11:
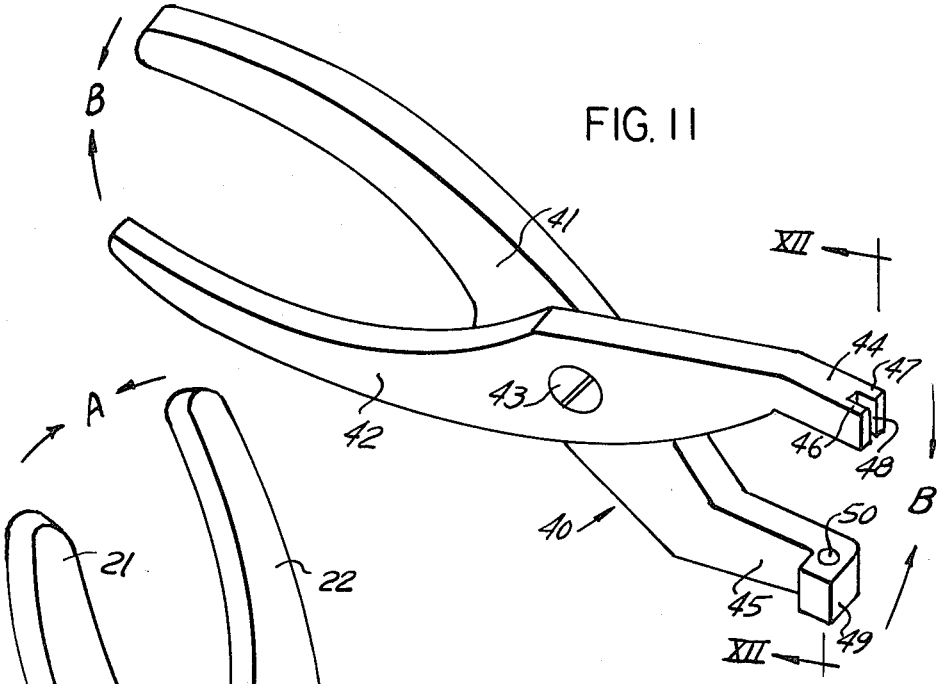
FIG. 11 illustrates a tool for use with the alternate wire piercing contact shown in FIGS. 7-8.

Turning to FIG. 11, a plier type tool 40 for use with the electrical contact 900 comprises a pair of body members 41, 42 pivotally coupled by a pin 43 with each body member including a handle and a jaw, the body members (and jaws) being adapted to move in a direction "B" to terminate the contact with the wire. One jaw 44 comprises a pair of positioning tongues 46, 47 spaced apart by a small amount to define a slot 48 disposed therebetween. The other jaw 45 comprises a body part 49 having a bore 50 disposed therein. When the body members 41, 42 are caused to move towards one another in the direction "B" the jaws 44, 45 approach one another with the slot 48 being brought into register with the bore 50.

Figure 12:
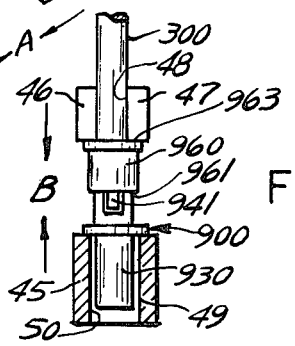
FIG. 12 is a sectional view of the tool of FIG. 11 taken along lines XII—XII showing the contact of FIGS. 7-8 being received therein.

Turning to FIG. 12, the contact 900 is seated in the pliers 40 with the forward part 930 of the contact being disposed in the bore 50. By applying a force on the handles in a forwardly direction "B", a force is exerted against surface 963 of sleeve 960. The outer sleeve end 961 cams against the cantilevers 941 and deflects them downwardly as the outer sleeve 960 moves forwardly and about the inner sleeve 920. Outer sleeve 960 will more forwardly until surface 961 butts against the shoulder 911 of contact body 910. The inner sleeve end 952 will pass axially rearwardly and seat beyond surface 962 of the outer sleeve 960, thereby allowing the finger 951 to spring radially outwardly and capture the outer sleeve 960.

Preferably and in accord with this invention, the contact in either embodiment would be stamped from flat metal stock and rolled into the desired shape although other expedients are possible. However, to reduce cost of manufacture or flexibility of use, some portions could be of insulative material (e.g. sleeve 960).

While there have been described what are at present considered to be the preferred embodiments of the invention, it will be understood that various modifications may be made therein, and it is intended to cover in the appended claims all such modifications as fall within the true spirit and scope of the invention. For example the invention could be extended to cable splicing. Also and in some applications, more than one lance could be used and the cantilever arms could be off-set relative to one another.

What is claimed is:

1. An insulation piercing contact for making good electrical and mechanical engagement with an associated insulated conductor wire, comprising:

a pair of conductive sleeves, said sleeves being telescopically interfittable with one another and slidably disposed for axial movement between first and second positions which define electrically unconnected and electrically interconnected positions respectively with the wire; and a deflectable cantilever arm extending outwardly from the inner of said telescoped sleeves, said cantilever arm having a pointed end to pierce through the insulation of the wire inserted with said inner sleeve, the outer of said telescoped sleeves having an opening for passing said cantilever arm outwardly to detain the two sleeves together in said first position and a cam disposed to urge against the cantilever arm and deflect the arm downwardly onto the wire and the pointed end into the wire when the second sleeve slides between the two axial positions.

2. An insulation piercing contact according to claim 1 further including a pair of openings on said outer sleeve and a pair of cantilever arms, each arm diverging outwardly from one another through a respective opening and from the inner sleeve, each opening having an edge defining the cam, the pointed end on each arm being adapted to be deflected downwardly by the cam to pierce the insulation.

3. An insulation piercing contact according to claim 1 wherein the pointed end comprises a pair of sharp biting tips formed at opposite ends of a circularly shaped insulation piercing end.

4. An insulation piercing contact according to claim 1 wherein said pointed end is V-shaped.

5. An insulation piercing contact according to claim 4 comprising a pair of laterally spaced V-shaped pointed ends.

6. In a separable electrical connector of the type including first and second connector members, one of the members being a receptacle and the other being a plug adapted to mate with the receptacle, each of the members including a dielectric insert with at least one socket contact being mounted in the insert of one member and a pin contact corresponding to the socket contact being mounted in the insert of the other member, the contacts having a mating end and a wire receiving end with the pin contact mating end being adapted for telescopic engagement with the mating end of the socket contact when the plug and receptacle are in mated relationship, the improvement which comprises:

means provided on the wire receiving end of at least one contact for piercing the wire insulation to make electrical contact with the wire inner conductor, said piercing means comprising:

an axially extending outer sleeve of resilient metal, the wall of said sleeve having an axially extending opening spaced from the mating end; and an inner sleeve slidably interfitted within the outer sleeve for movement between first and second axial positions which define electrically unconnected and electrically connected positions respectively, said inner sleeve including a contact finger extending as a cantilever beam outwardly therefrom with the contact finger being disposed between the axial ends of the opening, said contact finger having a sharp transverse end adapted to pierce the wire insulation and being deflectable downwardly towards the inner sleeve.

7. An invention as defined in claim 6 wherein said transverse end has a sharp V-shaped wire penetrating end portion.

8. An invention as defined in claim 6 wherein said transverse end is curved and includes a pair of sharp biting tips, said tips terminating each end of the curve.

9. An invention as defined in claim 6 wherein said transverse end comprises a pair of laterally spaced, V-shaped sharp wire penetrating ends.

10. An invention as defined in claim 6 wherein said inner sleeve includes an axial slot substantially in register with the axial opening, said contact finger has its root extend from one axial end of said slot and includes an exterior surface adjacent to one axial end of said opening, said one axial end of the opening being adapted to cam against the exterior surface to deflect the contact finger downwardly.

11. An invention as defined in claim 10 including releasable means for locking the inner sleeve in the second axial position relative to the outer sleeve.

12. An invention as defined in claim 6 wherein said outer sleeve includes a pair of like openings, said inner sleeve includes a pair of axial slots having like contact fingers extending therefrom as cantilever beams with their extended transverse ends being disposed between the axial ends of the openings, each of said openings and contact fingers being disposed diametrically around their respective sleeves.

13. An invention as defined in claim 12 wherein the wire receiving ends of each of the mateable pin and socket contacts are provided with said wire insulation piercing means.

14. A separable electrical connector assembly including a pair of connector members, one of said connector members being a receptacle and the other being a plug adapted to mate with the receptacle, said members being of resilient metal and each comprising a central body, a forward mating end, a rearward wire receiving end, a sleeve coaxially disposed to each wire receiving end, and means on the sleeve locking the sleeve to the wire receiving end in the terminated position, a wall portion of each wire receiving end defining therearound a pair of equiangularly spaced axial openings, each said sleeve being provided with a pair of slots in register with one of the openings and exposing a wire end disposed therein and also with a contact finger extending from each of the slots, each finger extending as a cantilever beam from an axial end of the respective slot and having a sharp end terminating the wire end, said sharp ends being convergent toward each other adjacent said terminated wire end with said sharp ends being spaced radially from and through the slots in the sleeve.

15. An insulation piercing contact for making good electrical and mechanical engagement with an associated insulated conductor wire, comprising:

a pair of conductive sleeves, said sleeves being telescopically interfittable with one another and slidably disposed for axial movement between first and second positions which define electrically unconnected and electrically interconnected positions respectively with the wire, said inner sleeve including means for locking the sleeves in the second and electrically interconnected positions; and a deflectable cantilever arm extending outwardly from the inner of said telescoped sleeves, said cantilever arm having a pointed end to pierce through the insulation of the wire inserted within said inner sleeve, the outer of said telescoped sleeves including an opening for passing said cantilever arm outwardly to detain the two sleeves together in the first position and having a cam disposed to urge against the cantilever arm and deflect the arm downwardly onto the wire and the pointed end into the wire when the second sleeve slides between the two axial positions.

16. An insulation piercing contact as recited in claim 15 wherein the first sleeve is the outer sleeve and includes a free end distal to the one end secured to the central body, the second sleeve is the inner sleeve and includes a free end having a portion thereof extending axially outwardly of the first sleeve, the locking means includes part of the inner sleeve free end portion having a resilient lance struck therein depressed by the outer sleeve, the lance being adapted to spring outwardly when the sleeves are in the second position and to abut a radial face of the distal free end of the outer sleeve thereby locking the sleeves in the second axial position.

17. An insulation piercing contact as recited in claim 15 wherein the second sleeve is the outer sleeve and the first sleeve is the inner sleeve, the outer sleeve having forward and rearward ends, the inner sleeve including a free end portion distal to the one end secured to the body, said inner sleeve free end portion including a flexible lance having a portion thereof adapted to spring outwardly of and hold the rearward end of the outer sleeve, thereby locking the sleeves in the second axial position.

18. An insulation piercing contact as recited in claim 16 or claim 11 wherein the free end portion of the second sleeve includes a radial lip defining a radial abutment surface, the radial abutment surface and the shoulder defining two surfaces adapted to be gripped in sliding the second sleeve between the first and second positions.

* * * * *